United States Patent [19]

Wahren et al.

[11] 4,100,018

[45] Jul. 11, 1978

[54] METHOD AND APPARATUS FOR FORMING A FIBROUS WEB

[75] Inventors: Douglas Wahren; Erik Gunnar Stenberg; Berndt Erik Ingvar Klerelid, all of Karlstad, Sweden

[73] Assignee: Aktiebolaget Karlstads Mekaniska Werkstad, Karlstad, Sweden

[21] Appl. No.: 698,538

[22] Filed: Jun. 22, 1976

[30] Foreign Application Priority Data

Jun. 23, 1975 [SE] Sweden ..... 7507159

[51] Int. Cl.[2] ..... D21F 1/00; D21F 9/00

[52] U.S. Cl. ..... 162/203; 162/301; 162/306

[58] Field of Search ..... 162/203, 213, 292, 301, 162/306, 303

[56] References Cited

U.S. PATENT DOCUMENTS

| | | | |
|---|---|---|---|
| 3,311,533 | 3/1967 | De Montigny et al. | 162/203 |
| 3,625,814 | 12/1971 | DeNoyer | 162/303 X |
| 3,726,758 | 4/1973 | Parker et al. | 162/301 X |
| 3,772,140 | 11/1973 | Kobayashi | 162/352 X |
| 3,846,232 | 11/1974 | Kankaanpaa | 162/203 X |
| 3,876,498 | 4/1975 | Justus | 162/203 X |
| 3,951,736 | 4/1976 | Kobayashi | 162/301 X |

*Primary Examiner*—Richard V. Fisher
*Attorney, Agent, or Firm*—Brumbaugh, Graves, Donohue & Raymond

[57] ABSTRACT

A method and apparatus for continuously forming a fibrous web in which a fibrous suspension is injected into a tapered throat formed by two running wires pervious to the suspension and converging to the periphery of an impermeable roll; the wires and the injected suspension therebetween are transported over a portion of the periphery of the roll under tension to form and dewater the injected suspension; as the wires run off the forming and dewatering roll, the web is sucked loose from the outer wire and it and the wires are transported over a convexly curved surface under tension; and the web is separated from the outer wire by off-running in the direction away from the convexly curved surface while the inner wire runs off that surface with the web, the convexly curved surface being impermeable at least at the wire separation location.

14 Claims, 5 Drawing Figures

Fig. 2
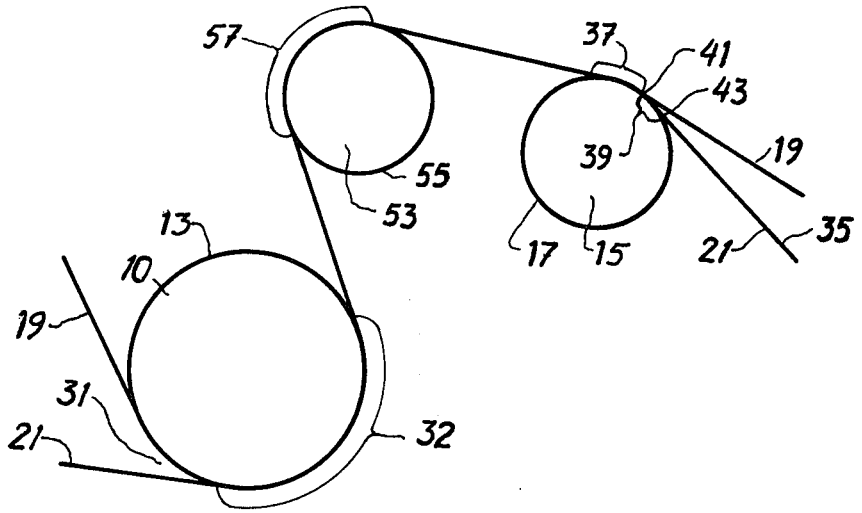
Fig. 3
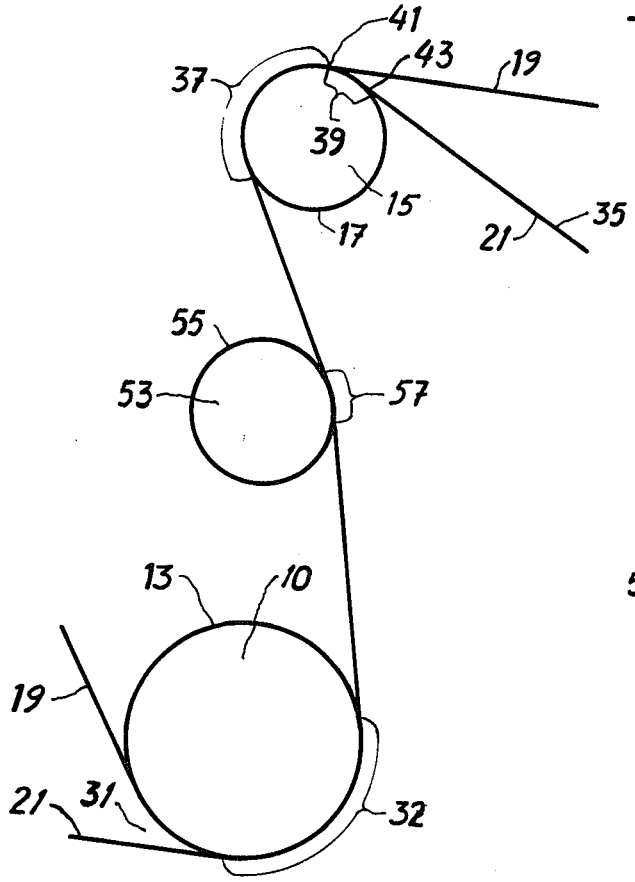
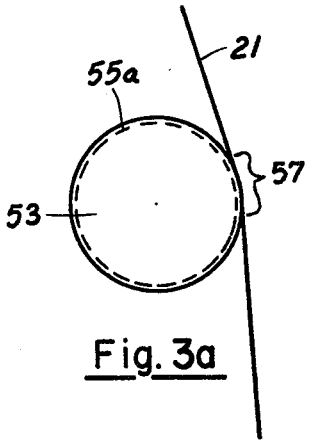
Fig. 3a

METHOD AND APPARATUS FOR FORMING A FIBROUS WEB

BACKGROUND OF THE INVENTION

The present invention relates to a method and apparatus for continuously forming a running fibrous web from a fibrous suspension injected between two running endless forming wires and dewatered to a fibrous web by the pressure exerted by the wires against the suspension therebetween along a treatment path.

The great demands now being made of such methods and apparatus, particularly with regard to the quality of the web at different surface weights and the specifications which the apparatus must meet constitute a problem which up to now has been only partly solved. It calls for a high dewatering capacity along a short dewatering path length. Also, the newly formed web must closely follow one of the wire belts or screens between which it has been formed, even at high machine speeds, without risk of splashing or ejecting pulp lumps which could fall back on the web and cause deterioration of its quality. Yet the adherence of the web to the wires must be such that the web can be removed therefrom without difficulty. In addition, the machine must have high operational reliability, minimum wire screen wear, uncomplicated components and low energy consumption, yet be low in cost and space requirements.

DESCRIPTION OF THE PRIOR ART

Attempts have been made heretofore to meet these requirements by using suction rolls and suction boxes to increase the web dewatering capacity and to cause the web to follow the proper wire. Such efforts have not been effective, partly because of the high initial cost and high power consumption of suction rolls and suction boxes with their associated pumps and tubings and because of the expense of maintenance and operation. Also, in such apparatus the web tends to adhere too firmly to the wire so that its removal is difficult. Moreover, paper qualitites having light surface weight such as tissue, for example, are often damaged when passing suction devices.

British Pat. No. 1,127,893 illustrates a prior art teaching which combines with suction rolls the additional complication of means for producing a parabolic configuration in a forming zone prior to formation of the web. This is accomplished by injecting the suspension on a forming wire reach having a substantial length before the forming wire meets an upper felt, a limited deflection being imparted to the forming wire and the felt such that the forming zone assumes a generally parabolic configuration. The forming zone is followed by a short dewatering zone in which the forming wire is returned to its normal undeflected position. For limited application with certain suspensions and speeds, a guide roll is used to produce the desired deflection of the forming wire and felt. For high speeds and paper qualities having light surface weight, i.e., tissue, specially formed guide shoes are used to produce the desired parabolic configuration.

It has also been proposed (see U.S. Pat. No. 3,876,498) to eliminate the disadvantages of suction rolls and suction boxes by using one large roll having an imperforate surface around part of which are wrapped two moving wires for forming and dewatering a fibrous web therebetween. The outer wire is separated from the inner wire at a first separation point on the roll surface and the inner wire is separated from the roll surface at a second separation point immediately thereafter with the web following the inner wire. However, the web has such a low dry content at the time of separation that injurious splashing occurs which cannot be completely eliminated by shields or the like. Also, moisture in the form of mist and splashes is emitted into the air surrounding the machine requiring that additional precautions be taken so that the machine environment will not be unpleasant or injurious to the health of personnel working there.

SUMMARY OF THE INVENTION

It is an object of the invention to provide a new and improved method and apparatus for forming a fibrous web which is substantially free from many of the above-noted deficiencies of the prior art.

According to the invention, a running fibrous web is formed continuously from a fibrous suspension by injecting the suspension centrally into a tapered throat formed by two running wires previous to the suspension and converging to the periphery of an impermeable roll; simultaneously forming and dewatering the injected suspension by a combination of wire tension and pressure applied to the wires as they are transported over a substantial part of the periphery of said roll; subjecting the web to a vacuum after off-running the wires from the roll to cause further dewatering of the web through the wire running closest to the impermeable roll as the wires are transported thereover; again subjecting the web to increased pressure and increased dewatering by passing the wires at least partly about a convexly curved surface located in spaced apart relation to the location where the off-running of the wires from the roll takes place; and separating the outer wire from the web by off-running in the direction away from said surface while the inner wire runs off said surface with the web, said surface being impermeable at least at the wire separation location.

The method according to the invention takes advantage of the vacuum produced in the nip at the off-running location, i.e., the "register roll effect," to suck the fiber web loose from the outer wire, the web when reaching the convexly curved surface again being pressed against the outer wire. This however, does not result in any essential dewatering through the outer wire so that the web can easily be removed from the web carrying wire at the separation location. Accordingly, the method and apparatus of the invention are eminently suited for forming tissue at high speeds.

By separating the wires after the application of increased pressure thereto at the convexly curved surface following dewatering along the treatment path over the impermeable roll, separation takes place in an environment which is much dryer than the zone immediately following the impermeable roll. In addition, the fiber web has a higher dry content when the wires are separated. As a result, splashing, which can damage the web, is avoided. Also, large amounts of liquid are not emitted into the surrounding air which improves the ambient conditions and reduces the air conditioning requirements.

As a consequence of the higher dry content at the location where separation of the wires takes place, less fibrous material tends to follow the "wrong" wire, i.e., the outer wire relatively to the convexly curved surface. In fact, such material in practice amounts to only one or a few tenths of a percent of the total surface weight, whereas in prior art techniques the amount is many times larger. The wire, accordingly, remains clean longer without impairing the quality of the web by introducing defects in the form of stripes or the like.

DESCRIPTION OF THE PREFERRED EMBODIMENTS

Figure 1:
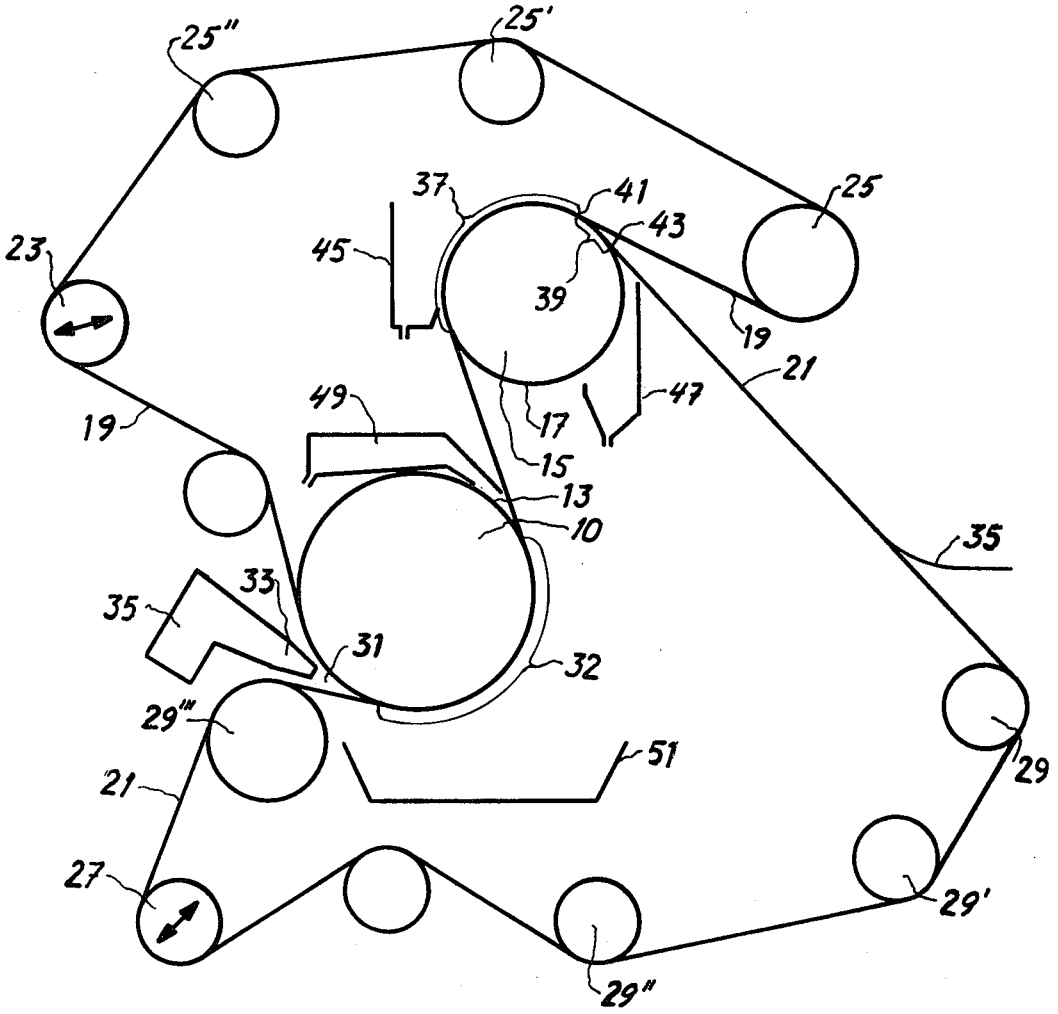

For a better understanding of the invention, reference is made to the following detailed description of several representative embodiments, taken in conjunction with the accompanying drawings in which:

FIG. 1 is a schematic diagram of web forming apparatus constructed according to the invention; and FIGS. 2, 3, 3*a* and 4 show schematically alternative support and separation surfaces for use in the web forming apparatus of FIG. 1.

FIG. 1 shows a paper making machine according to the invention comprising a rotatable forming roll 10 having an impermeable surface 13, a rotatable separation roll 15 having an impermeable surface 17, and inner and outer web forming wires 19 and 21, respectively. The inner (with respect to the roll 10) wire 19 is arranged to run in an endless loop enclosing the forming roll 10, the separation roll 15, a tensioning roll 23 and a plurality of support rolls 25, 25' and 25''. In similar fashion, the outer wire 21 is arranged to run in an endless loop enclosing the forming roll 10, the separation roll 15, a tensioning roll 27, and a plurality of support rolls 29, 29', 29'' and 29'''.

Ahead of the forming roll 10, the inner wire 19 and the outer wire 21 converge to form a tapered throat 31 into which a fibrous suspension is adapted to be continuously injected from a slice opening 33 in a head box 35 in the known manner. Beyond the throat 31, the wires 19 and 21 are wrapped around a substantial part of the surface 13 of the forming roll 10 constituting a forming zone 32 for dewatering and forming the injected fibrous suspension into a fibrous web 35.

From the forming roll 10, the wires 19 and 21 run along a common path extending upwards and somewhat inwardly over the forming roll 10 up to and around a part of the surface 17 of the separation roll 15, forming a dewatering zone 37 for additional dewatering of the fibrous web 35. Following the dewatering zone 37 is a separation zone 39 where the inner wire 19 (here the outer wire with respect to the separation roll 15) runs off the separation roll 15 from a first separation point 41 in the direction towards the support roll 25 and the outer wire 21 runs off the separation roll 15 from a second separation point 43 in the direction towards the support roll 29.

A plurality of suitable shields or savealls 45, 47, 49 and 51 are mounted in the vicinity of the rolls 10 and 15 as shown in FIG. 1, for collecting and transporting away the suspension liquid removed from the web 35 in the forming and dewatering operations.

In a typical operation, a fibrous web is formed by injecting a fibrous suspension continuously from the slice 33 centrally into the throat 31 between the inner and outer wires 19 and 21, which are running around part of the surface 13 of the forming roll 10 under tension produced by adjustment of the tensioning rolls 23 and 27 in the known manner. The combination of the wire tension and the pressure caused by the wrapping of the wires 19 and 21 around a substantial part of the periphery of the roll 10 on the fibrous suspension between the wires results in substantial dewatering of the latter in the forming zone 32. Further dewatering takes place through the inner wire 19 as the wires run off the surface 13 of the roll 10 because of the vacuum produced at the runoff location.

The wires 19 and 21 carrying the fibrous web 35 between them run from the forming roll 10 to the separation roll 15. There, the combination of the tension in the wires 19 and 21 and the wrapping of those wires around part of the impermeable surface 17 of the roll 15 causes further dewatering of the web 35 to take place in the dewatering zone 37. In order to obtain a high dewatering pressure, the diameter of the roll 15 is preferably smaller than the diameter of the forming roll 10.

On leaving the dewatering zone 37, the wires 19 and 21 run apart with a small angle between them as determined by the locations of the support rolls 25 and 29, respectively. Since the wire 21 is in contact with the impermeable surface 17 of the roll 15 as the wires run apart, the entire fibrous web 35 follows the wire 21.

FIG. 2 shows schematically a modification of the apparatus in FIG. 1 in which a turning roll 53, preferably of smaller diameter than the forming roll 10, is interposed between the latter and the separation roll 15. In this embodiment, the wires 19 and 21 after running off the forming roll 10 pass around part of the surface 55 of the turning roll 53 under tension, forming an additional dewatering zone 57. Alternatively, the separation roll 15 may be positioned above the forming roll 10 and the turning roll 53 interposed between them so as to deflect the wires 19 and 21 to the right, as shown in FIG. 3.

Figure 4:
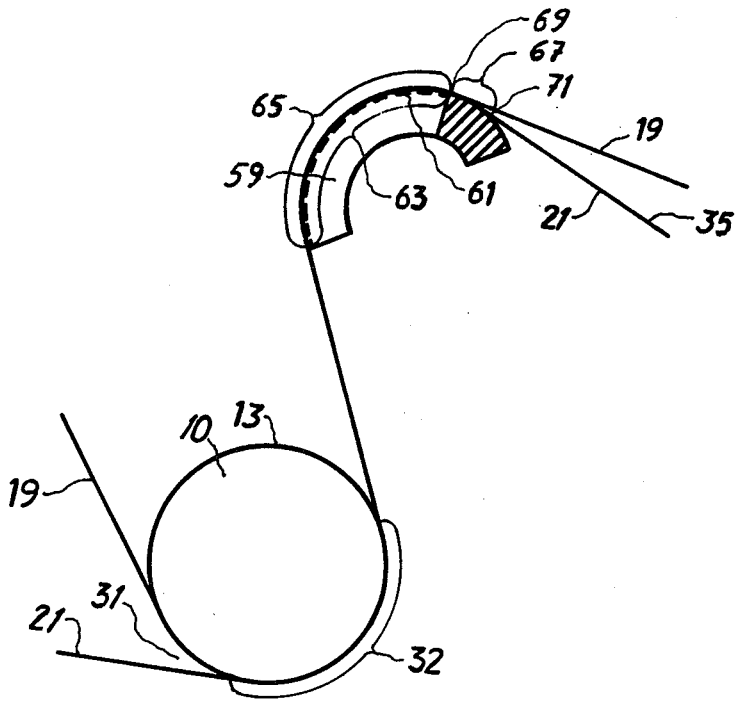

If desired, a fixed, convexly curved surface may be employed in place of the separation roll 10, as shown schematically in FIG. 4. In such case, the wires 19 and 21, after running off the forming roll 10, traverse a common path upwardly and somewhat in the inward direction above the forming roll 10 to an arcuate element 59 having a convexly curved surface 61 over which the wires 19 and 21 are adapted to slide. The wires 19 and 21 pass around a perforated or permeable portion 63 forming a dewatering zone 65 therewith.

The portion of the element 59 following the permeable portion 63 is impermeable and comprises a separation zone 67 from which the wires 19 and 20 run off in spaced apart relation from the separation points 69 and 71 as shown in the figure.

By virtue of the fact that the forming of the fibrous web 35 and the separation of the wire 19 therefrom take place at spaced apart locations and dewatering takes place by passing the wires and the web over the curved surface of a roll or element disposed therebetween, the dry content of the fibrous web is increased and the fibrous netting of the web is compressed without any change of its structure as formed in the forming zone 33. Actually, a dry content between about 8 to 13% may be obtained, meaning that only between 11.5 to 6.7Kg water follows each kilogram of fiber at the wire separation location, as compared with 20 to 25Kg water in the prior art.

Moreover, when such curved surfaces are impermeable, the compression presses the suspension liquid out of the fibrous web in the direction away from the curved surface. When, as a result, an excess of liquid is produced in and on the outer wire relative to the curved surface, drops form as a result of instability in the suspension liquid and are removed by centrifugal force.

By reason of the increased dry content of the web 35, the wires 19 and 21 can be separated with substantially less risk of deleterious splashing as compared with previously known arrangements.

An important feature of the present invention is that it utilizes no power demanding and wire wearing suction rolls or suction boxes. In the absence of such suc tion devices, the web is not adhered to the wires so firmly that its separation therefrom is difficult.

The support surfaces afforded by the turning rolls 53 in FIGS. 2 and 3, like the curved element 59 in FIG. 4, may be perforated, as shown at 55*a* in FIG. 3*a*, in which case centrifugal forces can freely act on the suspension liquid in the web, thereby increasing the dewatering rate. In this case, some dewatering can also take place inwardly of the support surface.

It will be understood that dewatering inwardly can be increased by applying vacuum inside the perforated surface of a support roll or curved support element. However, the increased wire wear and higher power consumption resulting when that is done in most cases more than outweigh the possible advantages.

As stated, the wires 19 and 21 are arranged to run off the separation roll 15 in FIGS. 1 through 3 or the curved support element 59 in FIG. 4 with a comparatively small angle therebetween. When there is a wet fibrous web 35 between the wires 19 and 21 the "register roll effect" at the separation surface in combination with adhesion forces between the web 35 and the outer wire 19 may cause the latter to be drawn downwardly, so that the wires 19 and 21 leave the separation surface together. As a result, the path of the wire 19 is not tangential but has a curvature immediately after the off-running of the wires from the support surface. The wire 19 then rolls or peels off the fibrous web 35 in the area where the "register roll effect" is acting. If, however, the angle between the unloaded wires 19 and 21 is too small, the wire 19 may not separate from the fibrous web in the area where the "register roll effect" is acting. As a result, separation becomes uncertain with the accompanying risk that flakes of the web may be ejected. It is, accordingly, important for the wire 19 running outside the web to be separated therefrom within the area where the "register roll effect" is acting. The most appropriate angle between the wires at the separation location varies depending on the qualities of the fibrous web 35; however, tests have indicated that the angle should not exceed 10°.

While the support surfaces in FIGS. 1 through 3 are shown as parts of the surfaces of rotatable rolls 15 or 53, they could be slide surfaces on a fixed arcuate element as in FIG. 4. Other modifications are possible within the scope of the invention as defined in the following claims.

We claim:

1. A method for continuously forming a running fibrous web from a fibrous suspension by injecting suspension between two running web forming wires that are pervious to the suspension liquid, forming and dewatering the injected suspension by passing the wires with the injected suspension therebetween over an arcuate segment of the impermeable surface of a forming roll while under tension, and thereafter separating the wires so that the web follows one of the wires, wherein the improvement comprises subjecting the web to further nonsuction dewatering to a dry content of about 8 – 13% at a location spaced apart from the forming roll by passing the wires and web after run-off from said forming roll and while under tension over a convexly curved surface that has a smaller radius of curvature than the forming roll and that has adjacent dewatering and wire separation portions, respectively, at least the wire separation portion being impervious, and thereafter separating the outer wire relative to said convexly curved surface from the web solely by running it off the impervious wire separation portion of said convexly curved surface in the direction away therefrom at an angle of less than 10° with respect to the inner wire while running the inner wire off the impervious wire separation portion of said convexly curved surface with the web.

2. A method as defined in claim 1 in which the wires and the web therebetween after running off the forming roll but before reaching said convexly curved surface are subjected to additional non-suction dewatering by passing them, while under tension, over another curved surface spaced apart from the forming roll.

3. A method as defined in claim 1, in which the wires and the web therebetween, when passing over the convexly curved surface, are deflected in a direction opposite the direction of deflection of the wires and web at their passage over the forming roll.

4. A method as claimed in claim 1, in which the wires and the web therebetween are caused to run off the forming roll at a treatment path portion extending upwardly from the forming roll and in a direction inwardly over the roll.

5. Apparatus for continuously forming a running fibrous web from a fibrous suspension, comprising two endless web forming wires, means for translating said wires in closely adjacent relationship along a treatment path, means for translating said wires to converge in a throat at the entrance to said treatment path, means for injecting a fibrous suspension centrally into said throat, an impervious forming roll disposed to have a substantial portion of its surface traversed by said wires in said treatment path for simultaneously forming and dewatering fibrous suspension contained between the wires, and means forming an outlet end for said treatment path at which the wires are separated from one another with the web following one of the wires, wherein the improvement comprises a convexly curved surface of smaller radius of curvature than the forming roll disposed in said treatment path adjacent said outlet end and spaced apart from said forming roll, said convexly curved surface having a support portion along which the wires pass while under tension to further non-suction dewater the web to a dry content of about 8 – 13%, followed by an impermeable separation portion located nearest said outlet end, and means to run-off the outer wire from the web at the separation portion in a direction away therefrom and to run-off the inner wire from the separation portion at an angle of less than 10° to the outer wire, whereby the web follows the inner wire.

6. Apparatus as defined in claim 5 in which said convexly curved surface is the impermeable surface of a rotatable roll having support and separation portions for the wires.

7. Apparatus as defined in claim 5 in which the convexly curved surface is formed on a fixed element.

8. Apparatus as defined in claim 7 in which the non-suction support portion of the convexly curved surface is perforated.

9. Apparatus as defined in claim 5 in which a rotatable non-suction support roll is disposed between and spaced apart from said forming roll and said convexly curved surface so as to deflect the wires in the treatment path and cause dewatering of the web therebetween.

10. Apparatus as defined in claim 9, in which the rotatable support roll is perforated.

11. Apparatus as defined in claim 9, in which the rotatable non-suction support roll and the forming roll are disposed on the same side of the wires.

12. Apparatus as defined in claim 9, in which the rotatable non-suction support roll and the convexly curved surface are located on the same side of the wires.

13. Apparatus as defined in claim 5, in which the forming roll and the convexly curved surface are located on opposite sides of the wires, so that the outer wire relative to the forming roll becomes the inner wire relative to the convexly curved surface.

14. Apparatus as defined in claim 5 in which means is provided to cause the wires to run off the forming roll along a treatment path portion extending upwardly from the forming roll and in a direction inwardly over the roll.

* * * * *